United States Patent [19]

Enderlein, Jr.

[11] Patent Number: 4,767,278

[45] Date of Patent: Aug. 30, 1988

[54] BOAT PROPELLER

[76] Inventor: Emmanuel X. Enderlein, Jr., 1144 Barbara Dr., Cherry Hill, N.J. 08003

[21] Appl. No.: 309,032

[22] Filed: Oct. 6, 1981

[51] Int. Cl.[4] ..... F01D 5/28

[52] U.S. Cl. ..... 416/241 B; 415/212 R; 415/214; 416/93 A

[58] Field of Search ..... 416/241 A, 241 B, 241 R, 416/93 A; 75/123 L; 148/35, 139; 415/214

[56] References Cited

U.S. PATENT DOCUMENTS

| | | | |
|---|---|---|---|
| 2,044,294 | 6/1936 | Handler | 416/241 |
| 2,996,035 | 8/1961 | Torrey | 440/53 |
| 3,000,790 | 9/1961 | Wiltmoser | 148/35 |
| 3,269,351 | 8/1966 | Shimanckas | 440/65 |
| 3,729,345 | 4/1973 | Oda | 416/241 |
| 3,846,045 | 11/1974 | Mincuzzi | 416/241 A |
| 4,080,198 | 3/1978 | Heyer | 148/35 |
| 4,090,813 | 5/1978 | Minato et al. | 416/241 R |
| 4,096,002 | 6/1978 | Ikawa | 148/35 |
| 4,099,994 | 7/1978 | Ikawa | 148/35 |
| 4,338,128 | 7/1982 | Farge | 148/35 |

FOREIGN PATENT DOCUMENTS

| | | | |
|---|---|---|---|
| 0145282 | 12/1980 | Fed. Rep. of Germany | 145/35 |

*Primary Examiner*—Harvey C. Hornsby
*Assistant Examiner*—Frankie L. Stinson
*Attorney, Agent, or Firm*—L. S. Van Landingham, Jr.

[57] ABSTRACT

Improved screw propellers especially useful in the propulsion of small boats are constructed at low cost from cast iron characterized by rounded graphite in a ferritic, pearlitic and/or acicular matrix. The propeller is exceptionally strong and may be driven by a prime mover at a speed up to 9,000 revolutions per minute without the blades losing their pitch or being easily damaged when submerged objects are struck at high speed. The disclosure is also concerned with outboard motors provided with the ductile iron propeller of the invention, and with small power boats having a propulsion unit which includes the ductile iron propeller of the invention. The propeller has certain preferred dimensions and characteristics, and should be constructed from ductile iron having the composition disclosed herein. The disclosed ductile iron propeller improves the operation of propulsion units of the type normally provided with inexpensive light weight propellers for the reasons noted herein. The disclosure also relates to a method of operating a power boat having a propulsion unit including the propeller of the invention.

25 Claims, 1 Drawing Sheet

BOAT PROPELLER

THE BACKGROUND OF THE INVENTION

1. The Field Of The Invention

The present invention broadly relates to boat propellers and, more particularly, to improved screw propellers adapted to be driven by a prime mover at high speeds and used in the propulsion of small power boats. The invention is further concerned with boats propelled by a propulsion unit including the propeller of the invention, and with outboard motors which are provided with the propeller of the invention as a component thereof. The invention also provides a method of operating a power boat having a propulsion unit including the propeller of the invention.

2. The Prior Art

Screw propellers have been used for many years in propulsion systems for various types of watercraft. Usually a propeller having a predetermined diameter and pitch is mounted adjacent the stern of the watercraft at or below the water line, and the watercraft is provided with a prime mover adapted to drive the propeller at the required number of revolutions per minute to generate the thrust needed to propel the watercraft at the desired speed. In order to generate a required amount of thrust from a given horsepower one may increase or decrease the diameter of the propeller, the pitch of the propeller blades, and/or the operating speed of the propeller in revolutions per minute. The amount of thrust that is developed in a given instance may be increased by increasing the diameter, operating speed and/or blade pitch of the propeller, and similarly, the amount of thrust may be decreased by decreasing the diameter, operating speed, and/or blade pitch. Additionally, salt water is heavier than fresh water, and thus a screw propeller develops more thrust in salt water than in fresh water when operated under a given set of conditions.

It is apparent from the foregoing that the optimum size, construction and design of screw propellers will differ from one type of watercraft to another. For instance, the massive propellers employed in propulsion systems for ocean going vessels and other commercial watercraft of medium to large size are of markedly larger diameter and have heavy blades with much thicker cross sectional dimensions than the propellers used for small commercial and recreational boats. The thick blades are very strong and under normal operating conditions, they are not subject to the mechanical damage, distortion, deflection and/or pitch change which is characteristic of the propellers described hereinafter for use with small commercial and recreational boats. Also, since ocean going and other relatively large commercial vessels are operated in deep water, the propeller diameter may be increased with little danger of the rotating blades striking submerged objects and being damaged thereby. Propellers of large diameters may be employed, and relatively low operating speeds in terms of revolutions per minute may be used to provide the necessary amount of thrust to propel the vessel. Operating the propeller at slower speeds tends to reduce turbulence and increase efficiency. Thus, as a general rule the propellers of large commercial vessels are operated at markedly slower speeds than those of small commercial and recreational boats. The initial cost of propellers for large commercial vessels usually is not an important factor in the overall cost of the vessel, and high cost metals and metal alloys may be used as materials of construction.

Screw propellers used in the propulsion of small commercial and recreational boats differ markedly from the above described propellers for large vessels and must meet a number of special requirements from the standpoint of size, construction and design, and also from the standpoint of economics. Small boat propellers have diameters of about twenty inches or less and thin blades with a maximum thickness of about one inch or less, and therefore they are much lighter in weight and the blades tend to have less strength. Small boat propellers are operated at high speeds in order to provide sufficient thrust, such as up to about 9,000 revolutions per minute, and especially when used in a propulsion system for a recreational high speed boat. When a boat propeller is operating at high speed, there is a tendency for the thin, blades to deflect, distort and/or lose their pitch due to the increased stress. This in turn decreases the amount of thrust which would otherwise be available for a given speed of operation. As a result, it is advisable to construct boat propellers that are about thirteen inches and larger in diameter from stainless steel in order to have sufficient strength in the blades. Smaller diameter boat propellers are usually constructed from aluminum, bronze or plastics. However, even these small diameter propellers are often subject to loss of pitch at operating speeds approaching 6,000 to 9,000 revolutions per minute. There is also a problem with respect to damage of the blades when objects are struck during high speed operation due to the relatively low strength of the thin blade sections. A stainless steel propeller of comparable size is a definite added advantage in this respect, but stainless steel small boat propellers are so expensive that they are not normally used except when necessary. Prior to the present invention most small boat owners used the less costly propellers prepared from aluminum though they were not generally satisfactory.

THE SUMMARY OF THE INVENTION

The present invention overcomes the aforementioned and other disadvantages and deficiencies of the prior art. This is accomplished by providing the novel screw propeller of the invention for use in the propulsion of boats having a prime mover adapted to drive the propeller at high speeds up to about 9,000 revolutions per minute.

The propeller has a plurality of blades and an effective outside diameter when rotating and measured at the rotating blade tips varying between about four inches and about twenty inches. The blades when measured next to or adjacent the hub of the propeller have a maximum thickness varying from approximately $\frac{3}{8}$ inch for a four inch propeller to about one inch for a twenty inch propeller. The blades have a desired initial pitch of about 5° to 35°, and the propeller is so constructed and designed whereby it may be immersed in water and driven at speeds up to about 9,000 revolutions per minute without the blades noticeably losing their initial pitch. The propeller is constructed from cast iron characterized by rounded or spheroidal graphite in a ferritic matrix, pearlitic matrix, acicular matrix, or admixtures thereof. The cast iron also has a composition as further defined hereinafter.

The as cast propeller may be heat treated, such as by annealing, to further improve its physical properties. However, very satisfactory propellers may be produced in the as cast condition and this is advantageous from the standpoint of lowering costs. The cast iron compositions also may be cast in high speed commercial machines which are capable of producing a plurality of propellers per minute to thereby markedly reduce production costs.

The propellers of the invention are exceptionally strong and durable, and are far superior to aluminum, bronze and plastic propellers of comparable size. There is no noticeable deflection or pitch change due to the speed of operation, and the diameter is not reduced noticeably due to rapid blade wear. The blades are not easily bent, chipped, mangled or broken when a submerged or floating object is struck during operation at high propeller speeds. As a result, the propellers of the invention have optimum operating characteristics over an extremely long lifespan which is at least five times greater than that of aluminum, bronze or plastic propellers.

The present invention also provides outboard motors and power boats which include the aforementioned novel propeller of the invention, and a method of operating the power boat. Reference may be had to the following detailed description and the accompanying illustrative drawings for a more thorough and complete understanding of the invention.

THE BRIEF DESCRIPTION OF THE ACCOMPANYING DRAWINGS

The invention will be described hereinafter in greater particularity with reference to the presently preferred embodiments thereof illustrated in the accompanying drawings, wherein.

Figure 1:
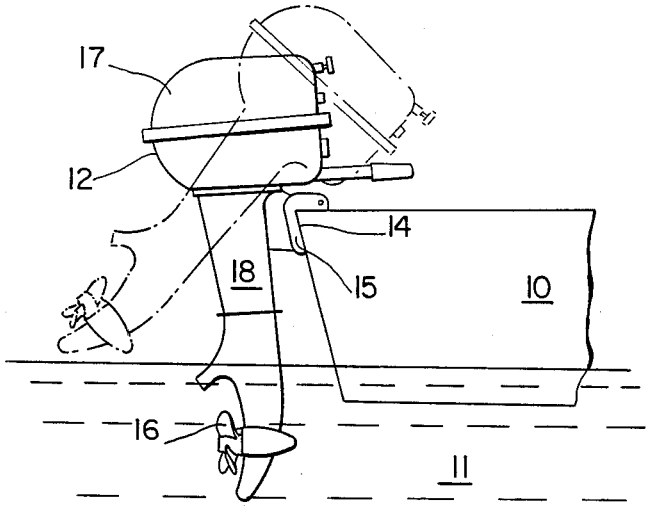
FIG. 1 is a side view in elevation, with portions thereof being broken away for purposes of clarity, illustrating an outboard motor which is removably attached to the transum of a small boat and fitted with a propeller of the invention, and with means being provided for tilting the outboard motor whereby the propeller may be raised out of the water.

The aforementioned figures of the drawings are referred to and discussed hereinafter in greater detail.

THE DETAILED DESCRIPTION OF THE INVENTION INCLUDING THE PRESENTLY PREFERRED VARIANTS AND EMBODIMENTS THEREOF

Referring now to the drawings, the small power boat 10 floating in water 11 has an outboard motor 12 removably and adjustably mounted on transum 14 by means of mounting bracket 15. When used to propel the boat 10, the outboard motor 12 is mounted in the position shown in solid line and the propeller 16 is beneath the surface of water 11. When the outboard motor 12 is not in use, it may be tilted on mounting bracket 15 to the position shown in phantom line whereby the propeller 16 is raised out of the water 11. It is also possible to release the mounting bracket 15 and remove the entire outboard motor 12 from its operating position on transum 14 and from water 11.

With the exception of screw propeller 16, the boat 10, outboard motor 12, mounting bracket 15 and the apparatus operatively associated therewith may be of general prior art construction and design. Numerous United States patents may be referred to in this respect, including U.S. Pat. Nos. 2,996,035, 3,018,989, 3,269,351, 3,333,798, 3,357,393, 3,406,652, 3,426,723 and 3,434,448, the disclosures of which are incorporated herein by reference. As is well known by those skilled in this art, the outboard motor 12 has a power head 17 including a prime mover such as an internal combustion engine or electric motor (not shown) which, through the usual drive shaft and gears (not shown) arranged within housing 18, drives the propeller 16 at a desired speed to thereby propel the boat 10. The boat 10 is propelled at a speed which varies directly with the speed of propeller 16, and thus prior art means is often provided for controlling the speed of propeller 16. The propeller 16 may be driven at idling speeds of, for example, 10–50 or 75–100 revolutions per minute, or up to cruising or full power speeds of 200–1000, 2,000–4,000, or 5,000–6,000 revolutions per minute, or up to 9,000 in some instances. The aforementioned patents also disclose suitable means for raising and lowering the propeller 16 whereby it may be lowered into the water and raised from the water.

Figure 2:
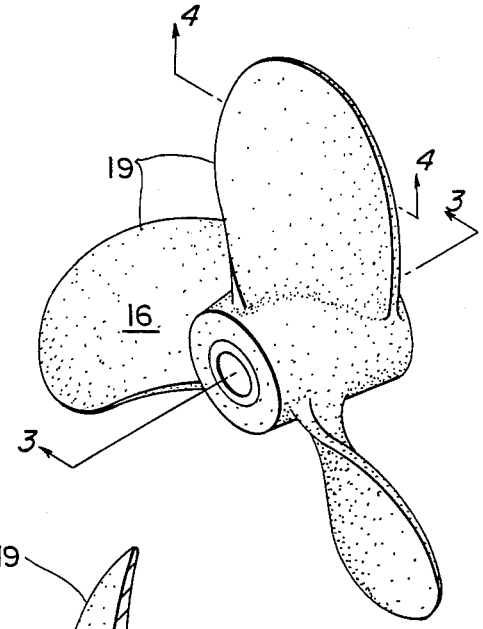
FIG. 2 is a perspective view of the propeller of the invention.
Figure 3:
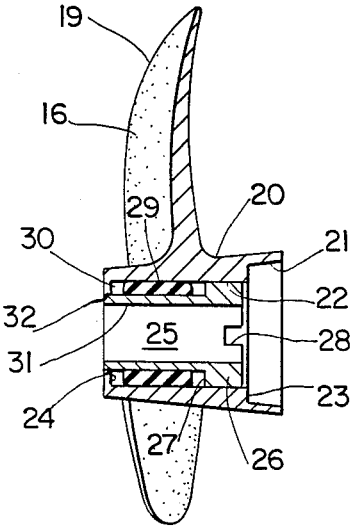
FIG. 3 is a longitudinal cross sectional view taken along the lines 3—3 of FIG. 2.
Figure 4:
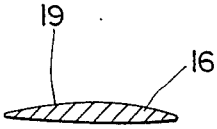
FIG. 4 is a transverse cross sectional view taken along the lines 4—4 of FIG. 2.

As is best seen in FIGS. 2–4, propeller 16 is a unitary casting including a plurality of blades 19 which extend outward from the generally annular hub 20 at intervals which are equally spaced circumferentially. The hub 20 is adapted to be mounted on the prior art drive shaft (not shown) of the prime mover of power head 17, and any suitable mounting means may be provided therefor. In the embodiment illustrated in the drawings, the hub 20 is provided with axially alligned intercommunicating openings 21, 22 and 32 which together form a continuous opening extending longitudinally between the forward and aft ends of hub 20. The openings 21, 22 and 32 have progressively smaller diameters to thereby form shoulders 23 and 24. The generally tubular adapter 25 has an outside diameter and terminal configuration on its outer end which allow it to be mounted and retained in the opening 32 in a close fitting rotatable relationship. On its inner end, the adapter 25 is provided with an enlarged annular portion 26 having an outside diameter such that it is received by the opening 22 in a close fitting but rotatable relationship. This arrangement provides an annular cavity 30 which extends longitudinally between shoulders 24 and 27 and receives the annular compressed rubber friction clutch 29. The inner end of adapter 25 is provided with a transverse slot 28 for receiving a conventional shear pin (not shown) carried by the drive shaft of the prime mover. The adapter 25 is also provided with a longitudinally extending opening 31 for receiving the prior art drive shaft (not shown) which carries the aforementioned shear pin for slot 28.

As will be recognized by those skilled in this art, the openings 21, 22 and 32, insert 25, clutch 29, and their associated elements may be modified as necessary to adapt the propeller 16 to the drive shaft of a desired conventional prime mover. However, it is essential that the blades 19 and the hub 20 be in the form of a unitary casting constructed from cast iron characterized by rounded graphite particles in a matrix structure, i.e., in a ferritic matrix, pearlitic matrix, acicular matrix, and/or admixtures thereof. Rounded graphite includes species of carbon sometimes known in this art by terms such as spheroidal, nodular, irregular nodular, compacted and vermicular graphite, and/or temper carbon. In some instances, more than one matrix structure may co-exist such as a ferritic-pearlitic matrix structure. The graphite particles may be present at densities up to about 1,000 particles per square millimeter of surface area (sq. mm), and they usually are present within a density range of approximately 50–750 sq. mm. In some instances, graphite particle densities of approximately 100–500 sq. mm. and preferably about 150–350 sq. mm. give exceptionally good results. The cast iron may have a composition consisting essentially of 2.0 to 4.5% carbon, 0.75 to 4.0% silicon, up to 2.0% manganese, up to 0.30% sulfur, up to 0.30% phosphorus, up to 0.12% magnesium, up to 1.0% chromium, up to 5.0% nickel, up to 2.0% copper, up to 1.00% molybdenum, up to 0.50% vanadium, up to 0.05% titanium, up to 0.30% tin, up to 0.03% rare earths, up to 0.03% bismuth, up to 0.004% boron, up to 0.004% tellurium, and the balance iron and residuals. Depending upon the specific chemical composition that is selected within the above ranges and the desired matrix structure, the casting may be in the as cast condition, i.e., without heat treatment, or it may be heat treated by, for example, annealing, normalizing, normalizing and tempering, quenching and tempering, and/or stress-relieving.

It is understood that within the aforementioned broad ranges of ingredients, there are certain preferred ranges which produce unusually good results. One presently preferred spheroidal or nodular cast iron composition having a ferritic, pearlitic or ferritic-pearlitic matrix structure consists essentially of 2.0 to 4.5% carbon, 1.5 to 4.0% silicon, up to 1.00% manganese, up to 0.02% sulfur, up to 0.10% phosphorus, up to 0.12% magnesium, up to 0.15% chromium, up to 3.5% nickel, up to 2.0% copper, up to 0.15% tin, up to 0.03% rare earths, and the balance iron and residuals. This composition is useful to produce spheroidal or nodular cast iron propellers having a ferritic and/or pearlitic matrix structure in the as cast condition prior to annealing, and a ferritic and/or pearlitic matrix structure subsequent to annealing.

An especially preferred specific cast iron composition for producing propellers with a ferriticpearlitic matrix structure in the as cast condition consists essentially of about 3.7% carbon, about 2.8% silicon, about 0.30% manganese, about 0.005% sulfur, about 0.02% phosphorus, about 0.05% magnesium, and the balance iron and residuals. An as cast propeller of this composition may be readily heat treated by annealing to produce a ferritic matrix structure and thereby increase the impact resistance and ductility.

An especially preferred specific cast iron composition for producing propellers with a pearlitic matrix structure in the as cast condition consists essentially of about 3.2% carbon, about 2.4% silicon, about 0.40% manganese, about 0.005% sulfur, about 0.02% phosphorus, about 0.05% magnesium, about 0.10% tin, and the balance iron and residuals. A propeller of this composition is especially useful in the as cast condition.

A presently preferred composition for producing spheroidal or nodular cast iron propellers with an acicular matrix structure in the as cast condition consists essentially of 2.0 to 4.0% carbon, 1.0 to 3.0% silicon, up to 1.00% manganese, up to 0.02% sulfur, up to 0.10% phosphorus, up to 0.12% magnesium, 2.5 to 4.5% nickel, up to 0.75% chromium, up to 1.00% molybdenum, up to 0.50% vanadium, up to 0.03% rare earths, and the balance iron and residuals. Within the above ranges, an especially useful composition consists essentially of about 3.4% carbon, about 1.50% silicon, about 0.60% manganese, about 0.005% sulfur, about 0.02% phosphorus, about 0.07% magnesium, about 0.40% chromium, about 3.40% nickel, about 0.75% molybdenum, and the balance iron and residuals. Propellers prepared from the aforementioned compositions for spheroidal or nodular cast iron with an acicular matrix structure are very satisfactory in the as cast condition. However, heat treatment may be employed when desired for specific needs or purposes.

Usually heat treatment is not required. This is advantageous from the economic standpoint as satisfactory propellers may be produced in the as cast condition and production costs are substantially lower. In instances where a heat treatment is needed to produce a given desired matrix structure and/or physical or mechanical properties, then a well known heat treating procedure for spheroidal or nodular cast iron may be selected and used. Thus, in general, the heat treatment of the propeller castings of the invention may follow the techniques which have been used heretofore for other types of spheroidal or nodular iron castings to achieve a desired result.

Heat treating procedures which may be used include annealing, normalizing, normalizing and tempering, quenching and tempering, and/or stress relieving by suitable prior art techniques for spheroidal or nodular cast iron articles. For instance, the as cast propellers may be annealed by heating at 1550°–1750° F. for one hour plus one hour per inch of thickness, followed by furnace cooling to 1200° F. maximum, and then furnace or air cooling to ambient temperature at a maximum cooling rate of 50° F. per hour. Another procedure involves heating the as cast propellers to 1650°–1750° F. and holding this temperature for about 4–6 hours, followed by slow cooling to 1400° F. over a period of approximately 2–6 hours, and then cooling to 1250° F. or below at the rate of 10° F. per hour and air or furnace cooling to ambient temperature. A typical annealing and normalizing step may involve heating the as cast propellers to 1650°–1750° F. and holding this temperature for about 4–6 hours, followed by slow cooling over 2–3 hours to 1600° F. , air cooling to ambient temperature, tempering at 1200° F. for one hour per inch of thickness, and air cooling to ambient temperature. A typical heat treating procedure for stress relieving involves heating the as cast propellers to 1150°–1250° F. and holding this temperature for one hour per inch of thickness, followed by air cooling to ambient temperature.

In view of the foregoing teachings and the present state of this art, superior propellers may be produced by selecting a chemical composition for the spheroidal or nodular cast iron and/or possibly a heat treatment therefor which provides optimum mechanical properties in the resultant finished castings. The tensile strength of the propellers should be at least 60,000 p.s.i., and is usually between 60,000 p.s.i. and 150,000 p.s.i. The yield strength, as determined by the offset method at 0.2%, should be at least 40,000 p.s.i., and is usually between 40,000 p.s.i. and 125,000 p.s.i. The percent elongation in 2 inches should be at least 1 or 2%, and is usually between 3% and 20%. The graphite particles should be essentially spheroidal or nodular and present in the matrix structure at particle densities up to 1000 per sq. mm., and are usually present at particle densities between 50 and 740 sq. mm. Presently preferred propeller castings often have tensile strengths of 60,000–100,000 p.s.i., yield strengths of 40,000–80,000 p.s.i., elongations of at least 3% and usually about 6–18%, and spheroidal or nodular graphite particle densities of about 100–500 sq. mm. and frequently about 150–350 sq. mm.

The hardness of the propeller is of importance, and especially the relative hardness of various portions of the propeller having markedly different thicknesses. The Brinell hardness may vary, for example, from about 350 at the surface of the blade tips where the maximum thickness is approximately ⅛", to about 175 in those portions of the propeller having thicknesses of ½ inch or more. The Brinell hardess may be, for example, about 300–400 in sections having a maximum thickness of ⅛ inch, about 200–350 in sections having a maximum thickness of 3/16 inch, about 150–250 in sections having a maximum thickness of ¼ inch, about 150–210 in sections having a maximum thickness of 5/16 inch, and about 140–200 in sections having a maximum thickness of ½ inch or more. Additionally, the surface hardness tends to follow the above Brinell values in relatively thick portions of the propeller casting. For example, the Brinell hardness beneath the surface may be about 300–400 at a depth of ⅛ inch, about 200–350 at a depth of about 3/16 inch, about 150–250 at a depth of ¼ inch, about 150–210 at a depth of 5/16 inch, and about 140–200 at a depth of ½ inch or more in instances where the total thickness is at least twice the depth at which the Brinell reading is taken. Propeller castings having ferritic-pearlitic matrix structures in the as cast condition also tend to be finer grained and more pearlitic in progressively thinner cross sections, and similarly, coarser grained and more ferritic in progressively thicker cross sections. Additionally, a section having a given thickness tends to be finer grained, harder and more pearlitic on the surface, and becomes coarser grained, softer and more ferritic with increasing depth until the center of the section is reached. For some reason which is not fully understood at the present time, the above mentioned differences in Brinell hardness and other properties which exist in different portions of as cast propellers having diameters between about 4 and 14 inches, and especially between 6 and 10 inches, appear to have a beneficial effect on the durability and overall performance of the propellers.

Heats of molten iron having the composition described herein may be easily prepared and handled prior to and during the casting operation. Preferably, the heat of molten iron is initially at a temperature of approximately 2750° F. at the start of the pour, and the pour is continued until the temperature falls to about 2550° F. Prior art automatic high pressure molding machines for green sand casting are very effective in casting the propellers of the invention, and the propellers may be cast very rapidly at production rates as high as one unit each 20 seconds. The castings are allowed to cool in the mold until solidified, and then are air cooled to ambient temperature. In instances where the propellers are about 14 inches or less in diameter, a subsequent heat treatment is usually not necessary. Propellers larger than about 14 inches may be heat treated as previously described. The as cast and/or heat treated propellers are cleaned and balanced following prior art techniques and preferably in automatic machinery for this purpose. The propellers are then ready for use on outboard motors or in other propulsion systems for power boats.

The propellers 16 of the invention have a plurality of blades 19 and an effective outside diameter when rotating and measured at the rotating blade tips varying between about 4 inches and 20 inches. While the propellers usually have three blades 19, it is understood that more or less than three blades may be present when desired, such as either two or four blades. The blades 19, when measured a substantial distance from the hub of the propeller such as about ¼–½ inch have a maximum thickness of approximately ⅜ inch for a four inch propeller, ½ inch for a 12 inch propeller, ⅝ inch for a 16 inch propeller, and about 1 inch for a 20 inch propeller. The blades 19 also have a desired predetermined initial pitch of about 8 to 30 and may be designed for rotation to the right or left. The propeller is also so constructed whereby it may be immersed in water and driven by a prime mover at speeds up to about 9,000 revolutions per minute without the blades noticeably losing their initial pitch. In FIGS. 3 and 4, the blades 19 are thicker along their longitudinal centerlines and reach a maximum thickness at a point adjacent the hub 20, and are tapered outward therefrom to a thickness of about 1/32–⅛ inch at the side edges and blade tips.

The propellers of the invention are surprisingly corrosion resistant in fresh water. However, better results are obtained by providing means for raising the propeller out of the water when the propulsion unit is not in use. The thin film of rust that forms on the propeller is removed during the next run and there is no deep rusting with frequent use. There also is no loss of pitch or deflection at operating speeds up to 9000 rpm, and the prime mover operates smoothly at full power without excessive vibration or noise. The propellers do not wear excessively at the blade tips, and the blades are not easily damaged when submerged objects are struck at high speeds. As a result of the foregoing, the propellers are very durable and are far superior to prior art plastic, bronze or aluminum propellers as cast propellers having diameters of about 4–14 inches are exceptionally useful.

The foregoing detailed description, the illustrative drawings, and the following Example are for purposes of illustration only, and are not intended as being limiting to the spirit or scope of the appended claims.

EXAMPLE

A heat of molten iron was prepared containing 3.45% carbon, 0.27% manganese, 0.038% phosphorus, 2.94% silicon, 0.033% magnesium, and the balance iron and residuals. A batch of propellers having a diameter of 8 inches and a pitch of 7° were cast from this heat in an automatic high pressure molding machine for green sand casting at the rate of about one for each 20 seconds. The heat had a temperature of about 2750° F. at the start of the pour, and the temperature was not allowed to drop below 2550° F. during the pour.

The propellers were allowed to solidify in the mold, and then were air cooled to ambient temperature. The cooled propellers were cleaned employing a prior art shot blasting apparatus for this purpose and statically balanced by prior art techniques.

One of the propellers was submitted for physical tests. The ultimate tensile strength was 75,250, the yield strength as determined by the offset method at 0.2% was 61,500, and the elongation in two inches was 19%. The matrix structure was a combination of ferrite and pearlite. The graphite particles in the matrix structure were substantially all spheroidal or nodular, and the graphite particle density was 160 to 350 per sq. mm.

Six of the propellers were installed on 6 horsepower Johnson outboard motors as replacements for the aluminum propellers previously used. The six outboard motors with the spheroidal or nodular cast iron propellers were used on small rental-type boats and their performance was compared under identical operating conditions with six 6 horsepower Johnson outboard motors having aluminum propellers. The outboard motors were tilted so as to raise both sets of propellers out of the water when not in use over an extended period of time, such as at the end of the day and until the outboard motors were in use once again to propel the boats. A thin film of rust formed on the cast iron propellers while raised out of the water. However, there was no extensive corrosion and the rust film disappeared during subsequent use of the outboard motors to propel the boats.

The two sets of propellers were tested under high speed operating conditions. The aluminum propellers were found to lose their pitch at operating speeds above 3500 to 5500 rpm. The outboard motors having the aluminum propellers could not be operated smoothly, because of damaged edges, distortion and loss of balance, and there was a marked loss of power under the high speed operating conditions. When the outboard motors having the spheroidal or nodular cast iron propellers were tested under identical conditions, there was no damage to the blade edges, loss of pitch, distortion or deflection at operating speeds up to 6000 to 9000 rpm. The outboard motors also operated smoothly, and without loss of power at all speeds up to 6000 to 9000 rpm.

The two sets of propellers were examined at the end of an extensive test period of several months during which all of the outboard motors were operated under identical conditions. The blades of the aluminum propellers were found to be badly worn, chipped, mangled and otherwise misshaped due in part to contact with submerged objects while operating at normal speed. There was also a very noticeable reduction in diameter due to excessive wear at the tips of the propeller blades. The spheroidal or nodular cast iron propellers, on the other hand, were not pitted, chipped, mangled, or deformed adversely. Also, there was no noticeable wear at the blade tips, and the diameters were the same as when originally installed.

It is therefore apparent from the above test results that the spheroidal or nodular cast iron propellers of the invention have a greatly extended life span over conventional aluminum, plastic or bronze propellers. Further, they also are not subject to loss of pitch and the other above mentioned operating disadvantages of aluminum propellers.

I claim:

1. A screw propeller for use in the propulsion of power boats provided with a prime mover adapted to drive the propeller at speeds up to about 9,000 revolutions per minute, the propeller having a plurality of blades and an effective outside diameter when rotating and measured at the rotating blade tips varying between about four inches and twenty inches, the said blades when measured a substantial distance from the hub of the propeller having a maximum thickness varying from approximately ⅜ inch for a four inch propeller to about one inch for a twenty inch propeller, the said blades having a desired initial pitch of about 8 to 30 degrees and the propeller being so constructed and designed whereby it may be immersed in water and driven by the said prime mover at speeds up to about 9,000 revolutions per minute without the blades noticeably losing their said initial pitch, the propeller being constructed from cast iron characterized by rounded graphite in a matrix structure selected from the group consisting of a ferritic matrix, pearlitic matrix, acicular matrix and admixtures thereof, and the said cast iron having a composition consisting essentially of 2.0 to 4.5% carbon, 0.75 to 4.0% silicon, up to 2.0% manganese, up to 0.30% sulfur, up to 0.30% phosphorus, up to 0.12% magnesium, up to 1.0% chromium, up to 5.0% nickel, up to 2.0% copper, up to 1.00% molybdenum, up to 0.50% vanadium, up to 0.05% titanium, up to 0.30% tin, up to 0.03% rare earths, up to 0.30% bismuth, up to 0.004% boron, up to 0.004% tellurium, and the balance iron and residuals.

2. The propeller of claim 1 wherein the said outside diameter is not greater than about 14 inches and the propeller is in the as cast condition.

3. The propeller of claim 1 wherein the propeller is constructed from spheroidal cast iron with a ferritic matrix, pearlitic matrix or ferritic-pearlitic matrix structure, and the said spheroidal cast iron has a composition consisting essentially of 2.0 to 4.5% carbon, 1.5 to 4.0% silicon, up to 1.00% manganese, up to 0.02% sulfur, up to 0.10% phosphorus, up to 0.12% magnesium, up to 0.15% chromium, up to 3.5% nickel, up to 2.0% copper, up to 0.15% tin, up to 0.03% rare earths, and the balance iron and residuals.

4. The propeller of claim 3 wherein the said outside diameter is not greater than about 14 inches and the propeller is in the as cast condition.

5. The propeller of claim 3 wherein the said spheroidal cast iron has a composition consisting essentially of about 3.7% carbon, about 2.8% silicon, about 0.30% manganese, about 0.005% sulfur, about 0.02% phosphorus, about 0.05% magnesium and the balance iron and residuals.

6. The propeller of claim 5 wherein the said spheroidal cast iron has a ferritic-pearlitic matrix structure in the as cast condition prior to annealing, and a ferritic matrix structure subsequent to annealing.

7. The propeller of claim 3 wherein the said spheroidal cast iron has a composition consisting essentially of about 3.2% carbon, about 2.4% silicon, about 0.40% manganese, about 0.005% sulfur, about 0.02% phosphorus, about 0.05% magnesium, about 0.10% tin, and the balance iron and residuals.

8. The propeller of claim 7 wherein the said spheroidal cast iron has a pearlitic matrix structure in the as cast condition.

9. The propeller of claim 1 wherein the propeller is constructed from spheroidal cast iron with an acicular iron matrix structure in the as cast condition, and the said spheroidal cast iron has a composition consisting essentially of 2.0 to 4.0% carbon, 1.0 to 3.0% silicon, up to 1.00% manganese, up to 0.02% sulfur, up to 0.10% phosphorus, up to 0.12% magnesium, 2.5 to 4.5% nickel, up to 0.75% chromium, up to 1.00% molybdenum, up to 0.50% vanadium, up to 0.03% rare earths, and the balance iron and residuals.

10. The propeller of claim 9 wherein the said spheroidal cast iron has a composition consisting of about 3.4% carbon, about 1.5% silicon, about 0.60% manganese, about 0.005% sulfur, about 0.02% phosphorus, about 0.07% magnesium, about 0.40% chromium, about 3.40% nickel, about 0.75% molybdenum, and the balance iron and residuals.

11. In an outboard motor for use in the propulsion of boats, the outboard motor including as components thereof a prime mover and a screw propeller which is driven thereby at speeds up to about 9,000 revolutions per minute, the improvement in combination therewith which comprises providing as the said screw propeller for the said outboard motor a propeller having a plurality of blades and an effective outside diameter when rotating and measured at the rotating blade tips varying between about four inches and twenty inches, the said blades when measured a substantial distance from the hub of the propeller having a maximum thickness varying from approximately ⅜ inch for a four inch propeller to about one inch for a twenty inch propeller, the said blades having a desired initial pitch of about 8 to 30 degrees and the propeller being so constructed and designed whereby it may be immersed in water and driven by the said prime mover at speeds up to about 9,000 revolutions per minute without the blades noticeably losing their said initial pitch, the propeller being constructed from cast iron characterized by rounded graphite in a matrix structure selected from the group consisting of a ferritic matrix, pearlitic matrix, acicular matrix and admixtures thereof, and the said cast iron having a composition consisting essentially of 2.0 to 4.5% carbon, 0.75 to 4.0% silicon, up to 2.0% manganese, up to 0.30% sulfur, up to 0.30% phosphorus, up to 0.12% magnesium, up to 1.0% chromium, up to 5.0% nickel, up to 2.0% copper, up to 1.00% molybdenum, up to 0.50% vanadium, up to 0.50% titanium, up to 0.30% tin, up to 0.03% rare earths, up to 0.30% bismuth, up to 0.004% boron, up to 0.004% tellurium, and the balance iron and residuals.

12. The outboard motor of claim 11 wherein the said screw propeller therefor has an outside diameter not greater than about 14 inches and the propeller is in the as cast condition.

13. The outboard motor of claim 11 wherein the said screw propeller therefor is constructed from spheroidal cast iron with a ferritic matrix, pearlitic matrix or ferritic-pearlitic matrix structure, and the said spheroidal cast iron has a composition consisting essentially of 2.0 to 4.5% carbon, 1.5 to 4.0% silicon, up to 1.00% manganese, up to 0.02% sulfur, up to 0.10% phosphorus, up to 0.12% magnesium, up to 0.15% chromium, up to 3.5% nickel, up to 2.0% copper, up to 0.15% tin, up to 0.03% rare earths, and the balance iron and residuals.

14. The outboard motor of claim 13 wherein the said screw propeller therefor has an outside diameter not greater than about 14 inches and the propeller is in the as cast condition.

15. The outboard motor of claim 14 wherein the said screw propeller therefor is constructed from spheroidal cast iron with an acicular iron matrix structure in the as cast condition, and the said spheroidal cast iron has a composition consisting essentially of 2.0 to 4.0% carbon, 1.0 to 3.0% silicon, up to 1.00% manganese, up to 0.02% sulfur, up to 0.10% phosphorus, up to 0.12% magnesium, 2.5 to 4.5% nickel, up to 0.75% chronium, up to 1.00% molybdenum, up to 0.50% vanadium, up to 0.03% rare earths, and the balance iron and residuals.

16. In a power boat propelled by a propulsion unit including a screw propeller driven at speeds up to about 9,000 revolutions per minute by a prime mover carried by the boat, the improvement in combination therewith which comprises including means for raising and lowering the said properller whereby the propeller may be lowered into the water when the propulsion unit is in use and raised out of the water when the propulsion unit is not in use, and providing as the said screw propeller for the said propulsion unit a propeller having a plurality of blades and an effective outside diameter when rotating and measured at the rotating blade tips varying between about four inches and twenty inches, the said blades when measured a substantial distance from the hub of the propeller having a maximum thickness varying from approximately ⅜ inch for a four inch propeller to about one inch for a twenty inch propeller, the said blades having a desired initial pitch of about 8 to 30 degrees and the propeller being so constructed and designed whereby it may be immersed in water and driven by the said prime mover at speeds up to about 9,000 revolutions per minute without the blades noticeably losing their said initial pitch, the propeller being constructed from cast iron characterized by rounded graphite in a matrix structure selected from the group consisting of a ferritic matrix, pearlitic matrix, acicular matrix and admixtures thereof, and the said cast iron having a composition consisting essentially of 2.0 to 4.5% carbon, 0.75 to 4.0% silicon, up to 2.0% manganese, up to 0.30% sulfur, up to 0.30% phosphorus, up to 0.12% magnesium, up to 1.0% chromium, up to 5.0% nickel, up to 2.0% copper, up to 1.00% molybdenum, up to 0.50% vanadium, up to 0.05% titanium, up to 0.30% tin, up to 0.03% rare earth, up to 0.30% bismuth, up to 0.004% boron, up to 0.004% tellurium, and the balance iron and residuals.

17. The power boat of claim 16 wherein the said screw propeller for the propulsion unit has an outside diameter not greater than about 14 inches and the propeller is in the as cast condition.

18. The power boat of claim 16 wherein the said screw propeller for the propulsion unit is constructed from spheroidal cast iron with a ferritic matrix, pearlitic matrix or ferritic-pearlitic matrix structure, and the said spheroidal cast iron has a composition consisting essentially of 2.0 to 4.5% carbon, 1.5 to 4.0% silicon, up to 1.00% manganese, up to 0.02% sulfur, up to 0.10% phosphorus, up to 0.12% magnesium, up to 0.15% chromium, up to 3.5% nickel, up to 2.0% copper, up to 0.15% tin, up to 0.03% rare earths, and the balance iron and residuals.

19. The power boat of claim 18 wherein the said screw propeller for the propulsion unit has an outside diameter not greater than about 14 inches and the propeller is in the as cast condition.

20. The power boat of claim 19 wherein the said screw propeller for the propulsion unit is constructed from spheroidal cast iron with an acicular iron matrix structure in the as cast condition, and the said spheroidal cast iron has a composition consisting essentially of 2.0 to 4.0% carbon, 1.0 to 3.0% silicon, up to 1.00% manganese, up to 0.02% sulfur, up to 0.10% phosphorus, up to 0.12% magnesium, 2.5 to 4.5% nickel, up to 0.75% chromium, up to 1.00% molybdenum, up to 0.5% vanadium, up to 0.03% rare earths, and the balance iron and residuals.

21. A method of operating a power boat when floating in a body of water, the power boat being of the class propelled by a propulsion unit including a screw propeller having an outside diameter not greater than about 20 inches which is driven at speeds up to about 9000 revolutions per minute by a prime mover carried by the boat, comprising providing as the screw propeller for the said propulsion unit a propeller having a plurality of blades and an effective outside diameter when rotating and measured at the rotating blade tips varying between about four inches and twenty inches, the said blades when measured a substantial distance from the hub of the propeller having a maximum thickness varying from approximately ⅜ inch for a four inch propeller to about one inch for a twenty inch propeller, the said blades having a desired initial pitch of about 8 to 30 degrees and the propeller being so constructed and designed whereby it may be immersed in water and driven by the said prime mover at speeds up to about 9,000 revolutions per minute without the blades noticeably losing their said initial pitch, the propeller being constructed from cast iron characterized by rounded graphite in a matrix structure selected from the group consisting of a ferritic matrix, pearlitic matrix, acicular matrix and admixtures thereof, and the said cast iron having a composition consisting essentially of 2.0 to 4.5% carbon, 0.75 to 4.0% silicon, up to 2.0% manganese, up to 0.30% sulfur, up to 0.30% phosphorus, up to 0.12% magnesium, up to 1.0% chromium, up to 5.0% nickel, up to 2.0% copper, up to 1.00% molybdenum, up to 0.50% vanadium, up to 0.05% titanium, up to 0.30% tin, up to 0.03% rare earths, up to 0.30% bismuth, up to 0.004% boron, up to 0.004% tellurium, and the balance iron and residuals, providing means for raising and lowering the said propeller whereby the propeller may be lowered into the water and raised from the water, the said propeller normally being raised out of the water when the propulsion unit is not in use, lowering the said propeller into the water and maintaining the propeller submerged therein at an effective depth while the propulsion unit is in use to propel the boat, and raising the said propeller out of the water when the propulsion unit is not in use to propel the boat for an extended period of time.

22. The method of claim 21 wherein the said screw propeller for the propulsion unit has an outside diameter not greater than about 14 inches and the propeller is in the as cast condition.

23. The method of claim 21 wherein the said screw propeller for the propulsion unit is constructed from spheroidal cast iron with a ferritic matrix, pearlitic matrix or ferritic-pearlitic matrix structure, and the said spheroidal cast iron has a composition consisting essentially of 2.0 to 4.5% carbon, 1.5 to 4.0% silicon, up to 1.00% manganese, up to 0.02% sulfur, up to 0.10% phosphorus, up to 0.12% magnesium, up to 0.15% chromium, up to 3.5% nickel, up to 2.0% copper, up to 0.15% tin, up to 0.03% rare earths, and the balance iron and residuals.

24. The method of claim 23 wherein the said screw propeller for the propulsion unit has an outside diameter not greater than about 14 inches and the propeller is in the as cast condition.

25. The method of claim 24 wherein the said screw propeller for the propulsion is constructed from spheroidal cast iron with an acicular iron matrix structure in the as cast condition, and the said spheroidal cast iron has a composition consisting essentially of 2.0 to 4.0% carbon, 1.0 to 3.0% silicon, up to 1.00% manganese, up to 0.02% sulfur, up to 0.10% phosphorus, up to 0.12% magnesium, 2.5 to 4.5% nickel, up to 0.75% chromium, up to 1.00% molybdenum, up to 0.50% vanadium, up to 0.03% rare earths, and the balance iron and residuals.

* * * * *